US007721628B2

(12) United States Patent
Lorger et al.

(10) Patent No.: US 7,721,628 B2
(45) Date of Patent: May 25, 2010

(54) MANUAL TONG

(75) Inventors: Tony Lorger, Eagleby (AU); Daniel Paul Lorger, Rollingstone (AU)

(73) Assignee: Drillroc Pneumatic Pty Ltd, Eagleby, Queensland (AU)

( * ) Notice: Subject to any disclaimer, the term of this patent is extended or adjusted under 35 U.S.C. 154(b) by 344 days.

(21) Appl. No.: 11/573,648

(22) PCT Filed: Aug. 15, 2005

(86) PCT No.: PCT/AU2005/001224

§ 371 (c)(1),
(2), (4) Date: Feb. 13, 2007

(87) PCT Pub. No.: WO2006/015454

PCT Pub. Date: Feb. 16, 2006

(65) Prior Publication Data

US 2008/0307929 A1 Dec. 18, 2008

(30) Foreign Application Priority Data

Aug. 13, 2004 (AU) ..... 2004904554

(51) Int. Cl.
*B25B 13/00* (2006.01)
*B25B 13/50* (2006.01)
*B25B 13/52* (2006.01)

(52) U.S. Cl. ..... 81/90.3; 81/57.33; 81/90.7; 81/91.2

(58) Field of Classification Search ..... 81/90.1–90.8, 81/65.2–65.4, 3.44, 185.1, 57.15, 57.33, 81/91.2

See application file for complete search history.

(56) References Cited

U.S. PATENT DOCUMENTS

| | | | | | |
|---|---|---|---|---|---|
| 257,344 | A * | 5/1882 | Kosinski | 81/65.2 |
| 1,626,238 | A * | 4/1927 | Hughes | 81/65.4 |
| 1,662,413 | A * | 3/1928 | Mussen | 81/65.4 |
| 2,423,326 | A * | 7/1947 | Jones | 81/90.4 |
| 3,695,125 | A * | 10/1972 | Glass et al. | 81/179 |
| 5,957,010 | A | 9/1999 | Petts | |
| 6,978,701 | B1 * | 12/2005 | Buchanan et al. | 81/91.2 |

FOREIGN PATENT DOCUMENTS

| | | |
|---|---|---|
| DE | 29905913 | 8/1999 |
| GB | 207359 | 11/1923 |
| SU | 1416660 | 8/1988 |

* cited by examiner

*Primary Examiner*—Hadi Shakeri
(74) *Attorney, Agent, or Firm*—Shoemaker and Mattare

(57) ABSTRACT

A manually or mechanically/hydraulically operable tong of light weight and high load capacity by means of a multi-layer interlocking construction achieved by cutting the shapes from plate steel by known means, assembling the plate sections in suitable order, and retained with each other by cylindrical steel pins (8) forming a multi hinged tool capable of engaging the job circumference on two or more points equally via replaceable jaw dies (15) retained radially and axially.

5 Claims, 4 Drawing Sheets

MANUAL TONG

FIELD OF INVENTION

Figure 1:
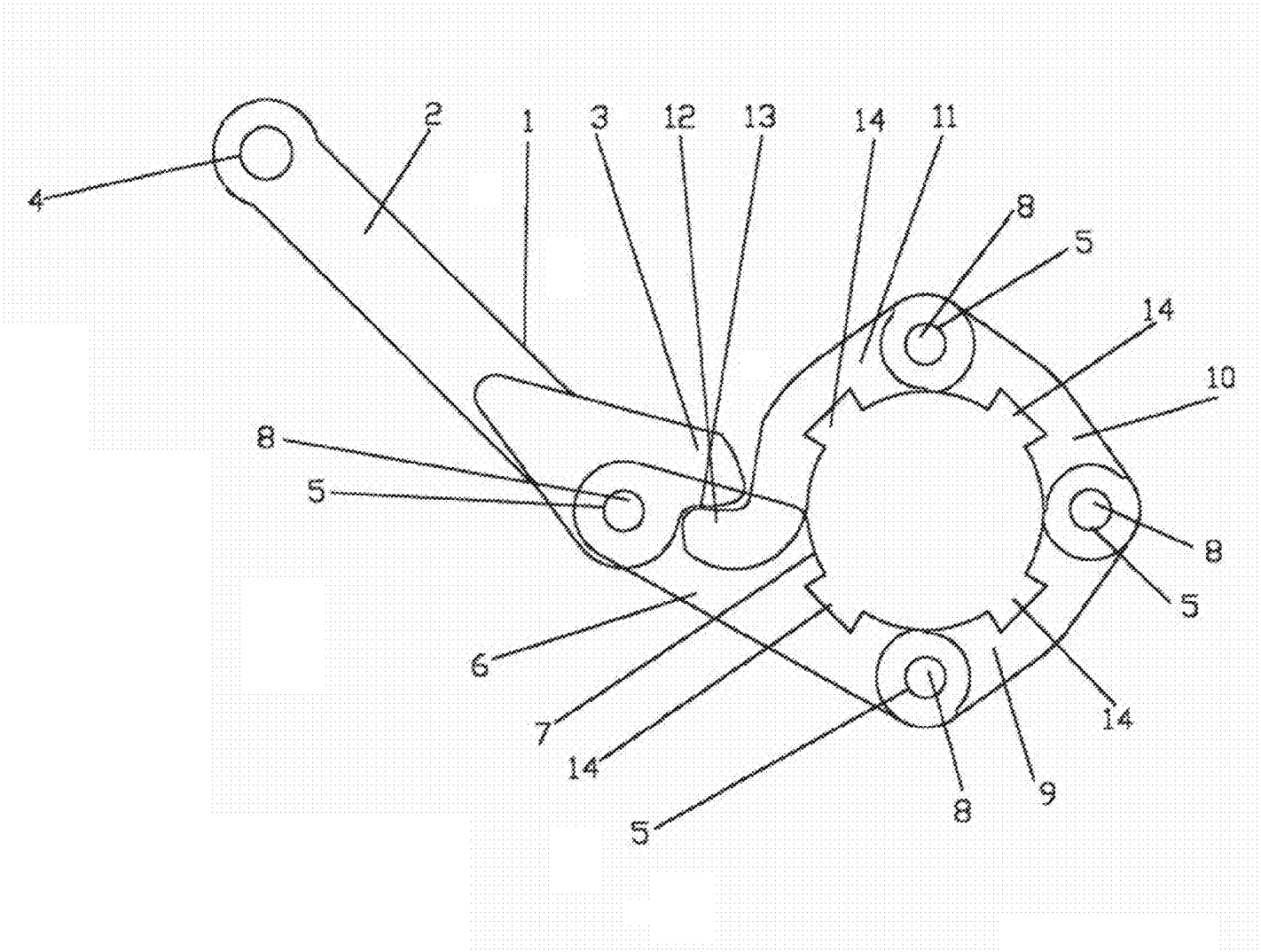

This invention has particular application to the mining, rock drilling, waterwell drilling, and horizontal drilling industries, wherein the enormous torque loads encountered often create great difficulty when unscrewing drill stems and other drilling tools as retracting from the borehole. However, it is envisaged that the invention will be beneficial to other industries where circumferential high force gripping of cylindrically shaped objects is required.

BACKGROUND OF THE INVENTION

In reference to pipe handling tools used in the drilling industry, there are those generally referred to as 'pipe tongs' or 'casing tongs'. Many of these are fully or semi automated units and are specific to the oil and gas drilling industry, and not within the scope of the present invention. Prior art tools relating to the present invention are more accurately described as 'manual tongs', 'chain tongs', 'Petol tongs', 'BV tongs', 'Rapspan tong', 'pipe wrench', or 'stilson', and are identified by having a handle, or lever, which serves to permit load being applied by hand, and, if so designed, also permitting the application of mechanical force to that lever.

Prior art tools rely heavily on the casting, forging, machining, and heat treatment processes as necessary to achieve the least practicable weight with the highest possible strength/torque/load capacity, since weight is a critical safety factor when large tools are to be man-handled, such as on waterwell and exploration mobile drillrigs. It has been common for several decades for manufacturers of these drills to fit as standard equipment an adjustable pipe wrench, modified by cutting the handle short, welding a lug to the shortened handle for attachment to a hydraulic cylinder, for the purpose of applying high torque to the drillpipe and drilling tools. Although relatively lightweight and easy to use, it is an inappropriate modification of a hand tool, and has become the accepted norm within the industry, notwithstanding the well documented injuries resulting from this unsafe practice.

These types of breakages are without warning as the component, whether faulty or overloaded, suddenly fails and the tool flies apart, severely injuring any body in its path. U.S. Pat. No. 6,119,558 seeks to minimise these injuries by the addition of a safety device in the case of such failures.

A well known and regarded tool is manufactured by Petol Tool Co, but this tool also is not without its problems in that it is cumbersome to man-handle, and heavily reliant on expensive manufacturing techniques.

U.S. Pat. No. 5,957,010 seeks to alleviate the downside of the Petol wrench by making a somewhat lighter but equally strong tool, at a lower cost. Although achieving this to a degree, in today's ever-cost conscious environment, it is still considered an expensive tool, due mainly to the extensive machining required in its manufacture.

SUMMARY OF THE INVENTION

In one aspect the present invention relates to a method of manufacture for a tool designed for hand or mechanical/hydraulic force actuation of cylindrical pipe and similar objects.

Another aspect of the invention is a tool designed for hand or mechanical/hydraulic force actuation, a multi hinged circumferential gripping tool of multi layer/laminated construction with replaceable jaws and means of axial retention of said jaws.

DESCRIPTION OF THE PREFERRED EMBODIMENT

FIG. 1:

Is an orthographic view of the individual components in an assembled state, showing the normally concealed contact point 13 of head 3 with heel 12 constrained between at least two numbers of plate section 6. In this view can be seen the dovetail cutouts 14 which subsequently locate the jaw 15.

FIG. 2:

Shows a preferred embodiment of the invention in the horizontal plane with the jaw 15 and retainer 16, installed.

A load applied to lever 2 in a counter-clockwise direction will pivot handle assembly 1, consisting of a combination of lever 2 and head 3, about its pivot pin 8, to apply clamping force at 13, thereafter gripping and rotating the job.

FIG. 3:

Is an orthographic view of an embodiment of the invention, without jaws fitted, permitting a greater scope of adjustment by the modification of at least one of components 6, 9, 10, 11, to incorporate at least one additional connection point 17.

FIG. 4:

For illustration and clarity, is provided a photograph of a preferred embodiment of the invention.

The tool has handle assembly 1 consisting of a lever 2 and a head 3. The lever end has a hole 4 for the convenient attachment of mechanical force device, usually a hydraulic cylinder. The head end has a hole 5 suitably positioned as to be the pivot point about which mechanical advantage is applied to the tool.

The next component of the tool is of a shape 6 with holes 5 each end, an inner curved edge forming an arc 7, one end retained to the head end of the handle assembly by a steel pin 8, thereby the first hinge point of the multi hinged tool.

Subsequent components 9, 10, 11 are attachment one to the other, in like manner.

Figure 3:
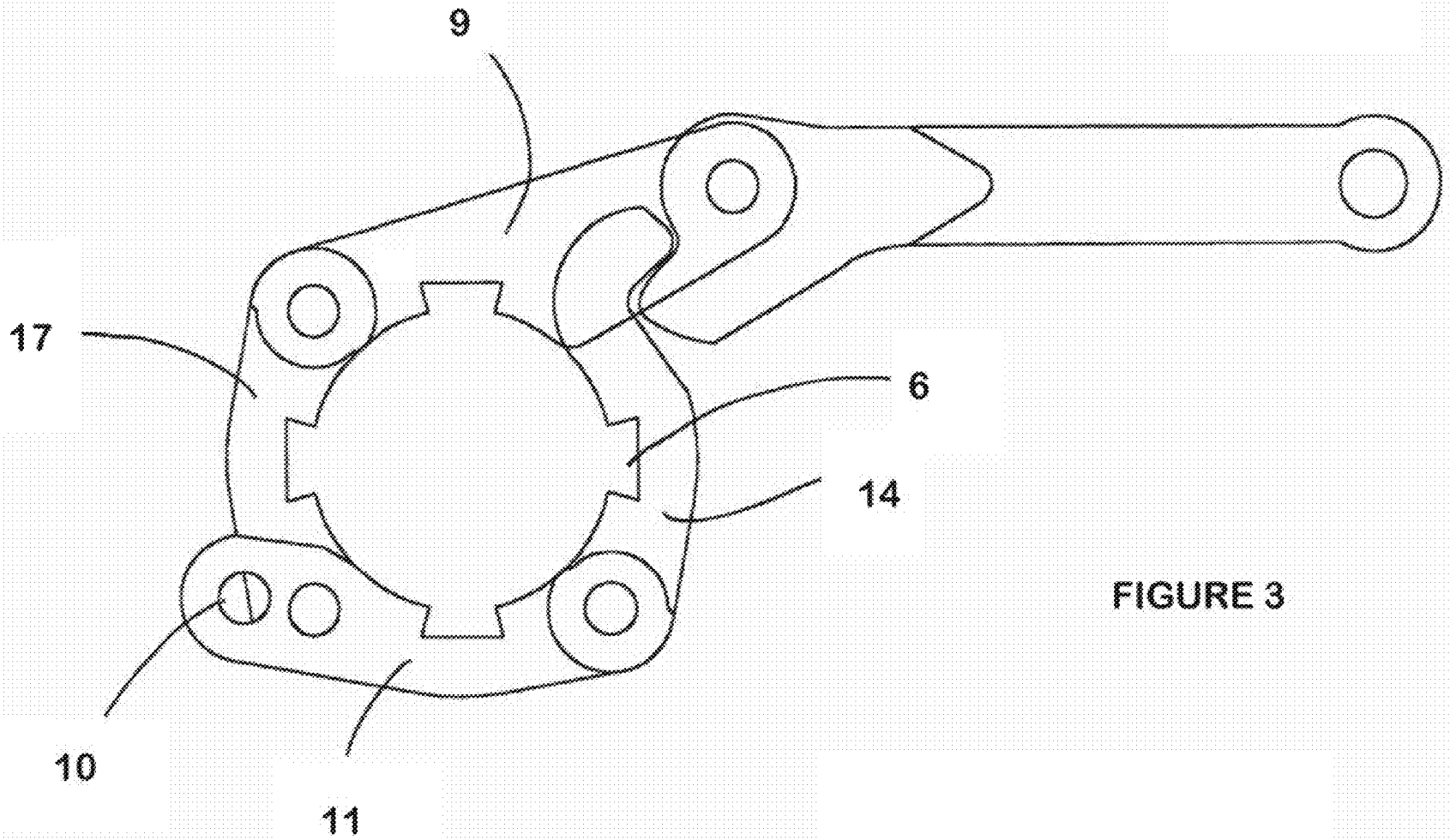
Figure 4:
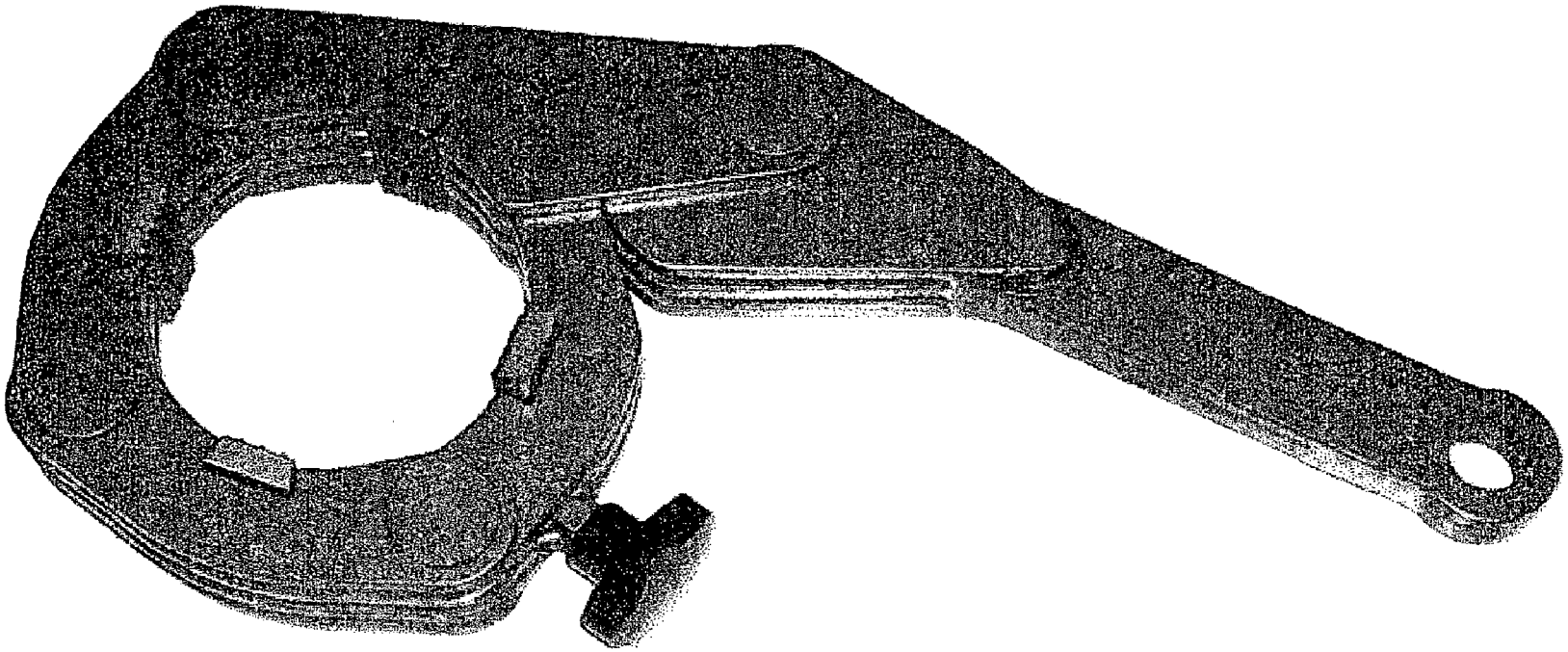

The last component 11 has a hole at one end for attachment to the previous component, the other end has a heel 12, which is shaped to suitably engage with the head 3. There may be more than one such heel capable of engaging the head, for instance, if an object is of a smaller diameter than the normal range of the tool, another heel would engage with the head, thereby applying gripping and torsional force to the smaller diameter. With reference to FIG. 3, the gripping range of the tool may also be increased by modification of at least one of components 6, 9, 10, 11, to incorporate at least one extra connection or pivot point 17. The extra connecting pivot may be a hole requiring the removal of the steel pin to align the new hole and refit the pin, or it may be a hooked latch arrangement, not requiring the steel pin removal.

The tool may consist of a number of such layers as is practical.

In application, each of the hinged components encompasses part of the circumference of the workpiece, the head is brought into contact with the heel and load is applied to the lever causing a circumferential compression of the tool onto the job in conjunction with the torsional force being applied.

Jaw Dies: most gripping tools are known to have some type of protruding, roughened or serrated surface, whether an integral part of the bodily section, a replaceable component, an applied coating, fitted or fixed by mechanical means, welding, brazing, etc.

Some gripping tools designed for rotational engagement rely upon frictional resistance alone, not having any visibly apparent gripping appendages.

It is envisaged that all known means for of gripping surfaces are applicable to our tool, however, we have developed specific replaceable jaws, retained in rotation circumferentially by a dovetail-like cut-out in the tool section with a corresponding angular dovetail shape on the jaw.

In axial plane however, the retention of the jaw insert, that is preventing the jaw from falling out, varies.

Prior tools of solid body construction, as opposed to our multi layer steel plate construction, with removable/replaceable jaws, vary from having welded or bolted small steel plates as axial retainers, interference fit retaining pins, and spring loaded steel pins retained within a countedrilled hole in the tool body, which is depressed, the jaw inserted, and the spring forcing the pin into a corresponding hole in the jaw, thereby preventing the axial falling out of the jaw.

Figure 2:
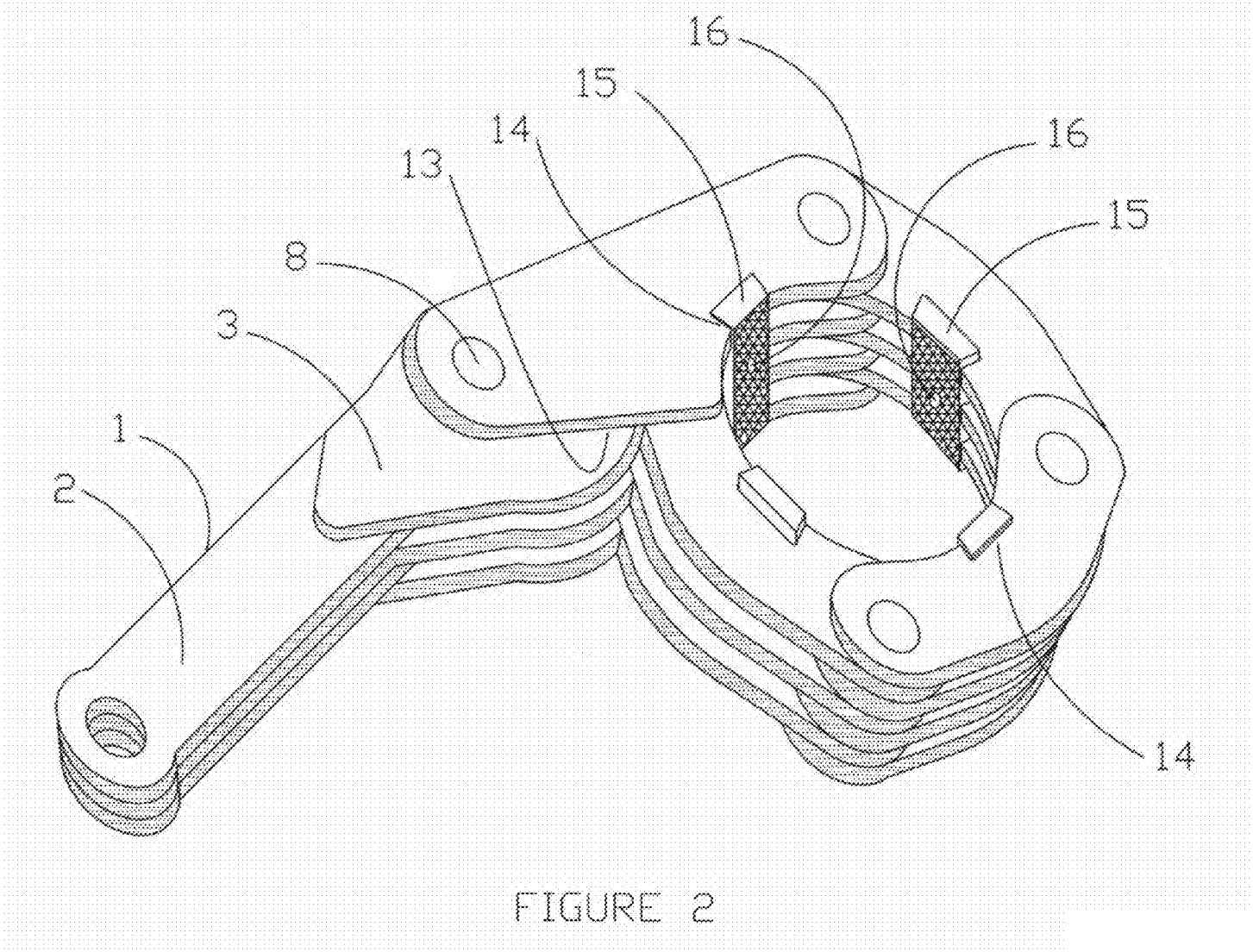

Because of the simple multi-layer design of the tool, the axial retention in the present invention is achieved by a threaded hole in the jaw body. With reference to FIG. 2, the assembly of the jaw to the tool is described: insert the jaw 15 into the corresponding dovetail 14 of the tool. The jaw is now retained radially but is free to drop out axially with the tool in the horizontal plane. Now since the tool is of a multi-layer plate construction, there are gaps between the plates corresponding to the plate thickness. Into the appropriate gap corresponding with the aforementioned threaded hole in the jaw, is inserted a retainer 16, ideally a set screw of suitable length, of similar diameter as the gap dimension, and of matching thread size in the jaw. Screwing the retainer into the back of the jaw far enough as to not protrude past the jaw teeth, but protruding from the rear of the jaw as to be constrained in the gap between the plates, provides simple and effective axial location of the jaw. The retainer 16 may also be inserted from the front, or gripping surface of the jaw 15.

Such a method permits quick and simple installation and replacement of the jaw.

The replacement jaw may be of the same or different thickness, thereby enlarging the scope of the tool to grip a larger range of diameters.

Some advantages of this design and method of manufacture are:

Low capital equipment requirement for manufacture.

Design alteration, in the sense that different sizes are quickly and simply made by scaling the drawing and cutting the shapes, no re-tooling.

The strength of the tool can be modified, i.e.; the tool can be constructed of thinner plate to reduce the weight for the purpose of ease of handling or for a light duty application. Alternatively, it can be made of thicker and or higher grade plate for heaviest duty applications, even increasing or decreasing the number of plates to alter the strength and weight.

This method of manufacture is applicable to prior art tools of similar purpose, and there is a significant cost and weight advantage, without loss of strength, in reconfiguring prior art tools to our style of design and manufacture.

The construction of this tool, being of plate steel, is not as vulnerable to the violent breakages under load as prior art tools of cast, forged, then heat-treated construction can be. These types of breakages are without warning as the component, whether faulty or overloaded, suddenly fails and the tool flies apart, injuring any body in its path. Conversely, steel plate, by its tensile nature, will bend and buckle if overloaded, releasing the pent up energy of the torque load force applied to the tool.

The scope and ambit of the invention have been clearly described herein, variations could be made by persons skilled in the art without deviating from that inherent ambit and scope, and any such variations and modifications are deemed inclusive.

The invention claimed is:

1. A circumferential gripping tool comprising:

a plurality of gripping segments defining a first and a last segment, each segment being formed from plural identical steel plates, the segments being interconnected by hinge pins at respective ends thereof, the plates of adjacent sections being interleaved at said ends, each segment having a retaining slot for receiving a gripping jaw;

a plurality of replaceable gripping jaws, a single one for each of said gripping segments, each gripping jaw being retained within the retaining slots of all of the plates forming the respective segment, and the tool further comprising;

a handle assembly consisting of a lever and a head, the lever having a hole at a proximal end, the head having a hole defining a pivot point retaining one end of said first segment by a steel pin, said last segment having at least one heel shaped to suitably engage a contact point of said head, said contact point concealed and constrained between at least two of said identical steel plates of said first segment;

wherein said handle assembly connected to said first segment and engaging said last segment applies a crushing force to a workpiece when a force is applied to said handle.

2. A circumferential gripping tool according to claim 1, wherein said handle assembly comprises a stack of metal plates welded together to form a rigid whole.

3. A circumferential gripping tool according to claim 1, wherein at least one of said segments has at least one additional hinge hole providing an extended range of tool size.

4. A circumferential gripping too according to claim 1, wherein each of said slots is a dovetail slot and each of said jaws has a correspondingly shaped cross-section.

5. A circumferential gripping tool according to claim 4, wherein each of said jaws is retained in said slots by a screw which protrudes between two plates of the respective segment to prevent the jaw from falling out of the slots lengthwise.

* * * * *